US008505865B2

(12) United States Patent
Wills et al.

(10) Patent No.: US 8,505,865 B2
(45) Date of Patent: Aug. 13, 2013

(54) ROLLER BLIND END BRACKET PLATE

(76) Inventors: Norman Wills, Mississauga (CA); Philip Ng, Thornhill (CA)

( * ) Notice: Subject to any disclaimer, the term of this patent is extended or adjusted under 35 U.S.C. 154(b) by 91 days.

(21) Appl. No.: 13/282,118

(22) Filed: Oct. 26, 2011

(65) Prior Publication Data

US 2013/0105649 A1 May 2, 2013

(51) Int. Cl.
*A47H 1/10* (2006.01)
*A47G 5/02* (2006.01)

(52) U.S. Cl.
USPC ..... 248/266; 248/224.8; 248/252; 160/323.1

(58) Field of Classification Search
CPC ..... E06B 9/324; E06B 9/50
USPC ..... 248/224.8, 266, 267, 273, 251, 252, 248/254; 160/173 R, 178.2, 323.1, 321, 160/23.1, 903; 359/461
See application file for complete search history.

(56) References Cited

U.S. PATENT DOCUMENTS

| | | | | |
|---|---|---|---|---|
| 1,672,683 | A * | 6/1928 | Knoderer | 220/3.8 |
| 2,329,435 | A * | 9/1943 | Colucci | 362/322 |
| 2,486,996 | A * | 11/1949 | Stuber et al. | 248/264 |
| 2,568,001 | A * | 9/1951 | Harris | 248/264 |
| 4,045,123 | A * | 8/1977 | Brown | 359/461 |
| 7,854,419 | B2 * | 12/2010 | Ng et al. | 248/269 |
| 2005/0205216 | A1 * | 9/2005 | Vrielink | 160/23.1 |

* cited by examiner

*Primary Examiner* — Anita M King
(74) *Attorney, Agent, or Firm* — Honigman Miller Schwartz and Cohn LLP

(57) ABSTRACT

An end bracket plate for a roller blind. The end bracket plate is releasably securable to the end bracket of the roller blind and releasably securable to the end panel of a head box enclosure. The plate includes one or more outwardly extending flanges which are receivable within one or more openings in the end panel of the head box such that when received within the openings in the end panel the one or more flanges hang the plate and the roller blind secured thereto within the head box.

10 Claims, 9 Drawing Sheets

(SECTION A-A)

ROLLER BLIND END BRACKET PLATE

FIELD

This invention relates generally to roller blinds, shades and other similar types of window covering, and in particular to an end bracket plate for such devices.

BACKGROUND

In many instances, roller blinds and window shades are either mounted externally to a window or internally within the limits of the window's frame. In other cases it is desirable to recess the blinds or shades within a ceiling or bulkhead, as is commonly the case in condominium and commercial construction where window glass may extend upwardly to, or near, an interior ceiling. Where the blind or shade is recessed, it is common to utilize an enclosure within which the roller blind can be mounted. The enclosure, or head box as it is sometimes referred to, is recessed into the ceiling or bulkhead structure such that its lower surface is at essentially the same elevation as that of the lower surface of the ceiling or bulkhead. The roller blind or shade may then be mounted within the head box to conceal it from sight and to permit the blind to be lowered vertically downward through the head box's open lower surface. In some instances a bottom plate is utilized in conjunction with the head box in order to partially close the bottom surface and further obscure the roller blind or shade and hardware from view.

Conventionally, the ends of such enclosures or head boxes are enclosed and their end panels are pre-drilled with a hole pattern that aligns with a hole pattern on the end bracket of the blind or shade. In this manner, installers need only insert the blind or shade into the head box and then pass fasteners through the holes in the end brackets and into the corresponding holes of the end panel of the head box (such holes typically being threaded) to secure the blind in place.

While such structures generally permit blinds or shades to be easily and quickly mounted within head boxes, the position of the blinds or shades within the head box are both pre-determined and fixed. In most instances, it is desirable to position a blind relatively close to the glass in front of which it is mounted. Having the blind located in close proximity to the glass provides advantages that include enhanced insulation, a better and more efficient blockage of light, and enhanced characteristics of light transmission through the fabric forming the blind. Currently available roller shades and head boxes, where the relative position of the shade within the head box is predetermined and fixed, fail to capitalize on the advantages of locating the blind fabric close to the window glass in front of which it is mounted where different diameters of cores, different lengths of blind fabric and different thicknesses of blind fabric are used. For example, small diameter cores will tend to result in an increased set-off of the blind fabric from the window glass while larger cores will tend to cause the blind fabric to be positioned closer to the window glass when the blind is in its closed position. There is therefore a need for an enhanced blind mounting structure that permits a fast, easy and efficient location of the blind fabric close to the window glass, regardless of the size and nature of the blind's core.

SUMMARY

The invention therefore provides an improved roller blind end bracket plate that addresses some of the deficiencies in currently available devices.

Accordingly, in one of its aspects the invention provides an end bracket plate for a roller blind, the bracket plate releasably securable to the end bracket of the roller blind and releasably securable to the end panel of a head box enclosure, said plate including one or more outwardly extending flanges, said one or more flanges receivable within one or more openings in the end panel of the head box such that when received within the openings in the end panel said one or more flanges hang said plate and the roller blind secured thereto within the head box.

Further aspects and advantages will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DESCRIPTION

The present invention may be embodied in a number of different forms. However, the specification and drawings that follow describe and disclose only some of the specific forms of the invention and are not intended to limit the scope of the invention as defined in the claims that follow herein.

Figure 1:
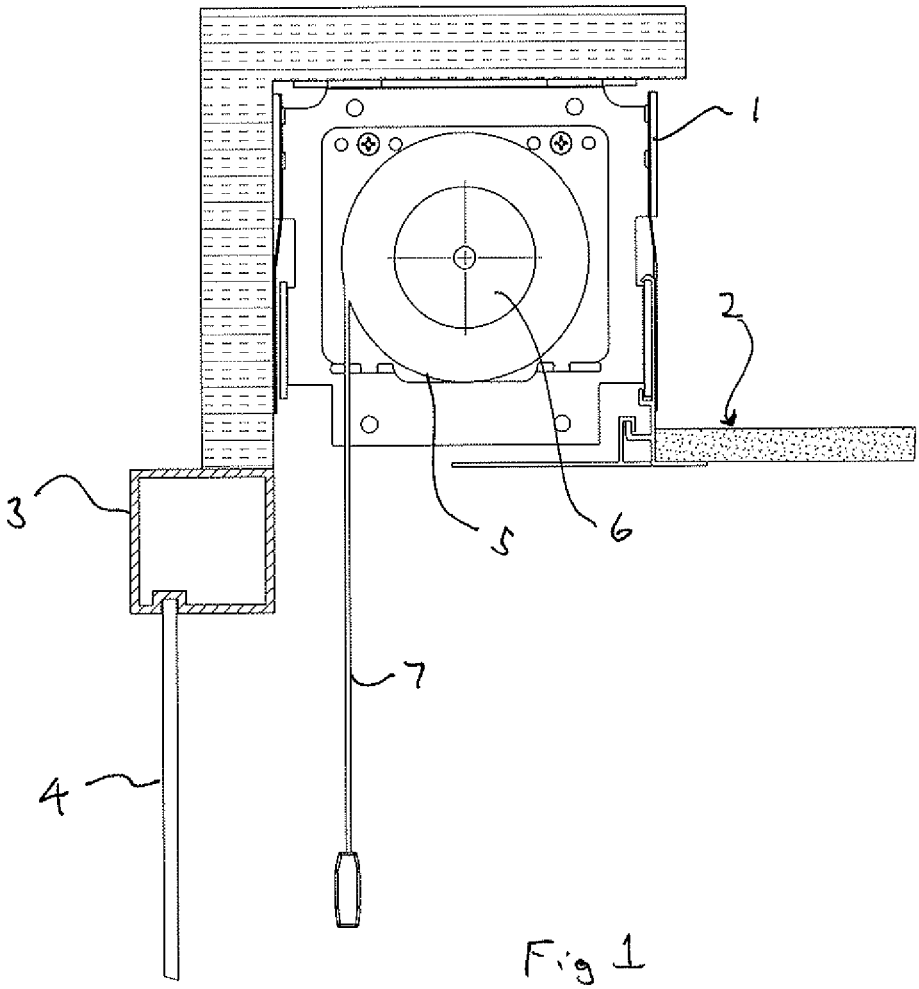
FIG. 1 is a vertical sectional view through a ceiling having mounted therein a head box with a roller blind secured to it through the use of a roller blind end bracket plate in accordance with an embodiment of the present invention, the roller blind end bracket plate being shown in a central position.
Figure 2:
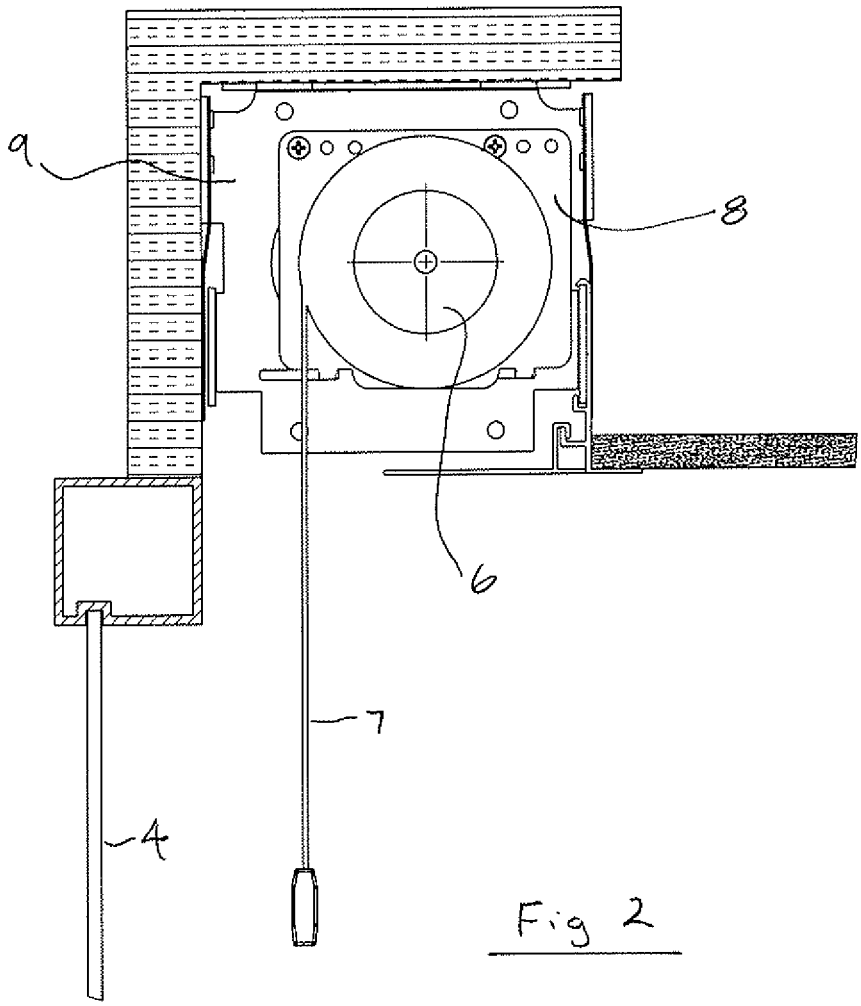
FIG. 2 is a side sectional view similar to that of FIG. 1 wherein the roller blind end bracket plate has been shifted to its outermost position.
Figure 3:
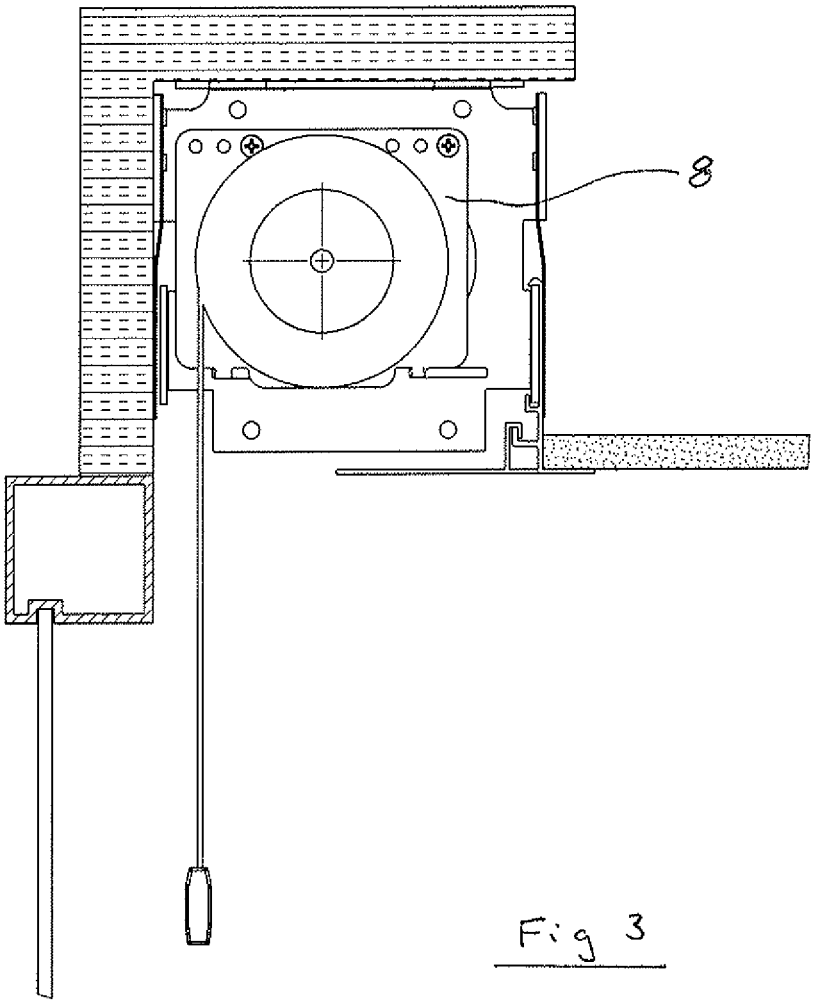
FIG. 3 is a side sectional view similar to that in FIG. 1 wherein the roller blind end bracket plate has been shifted to its innermost position.
Figure 4:
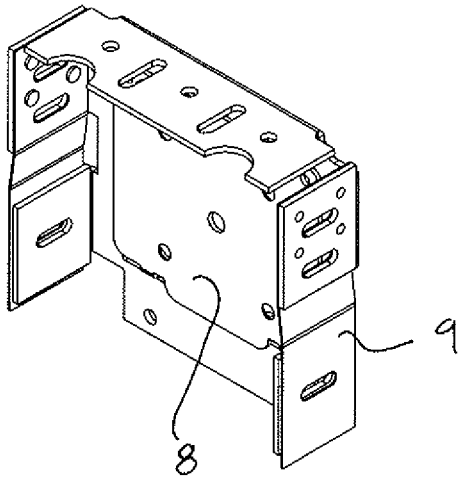
FIG. 4 is an upper interior side perspective view of an end panel of a head box having mounted therein a roller blind end bracket plate in accordance with an embodiment of the present invention.
Figure 5:
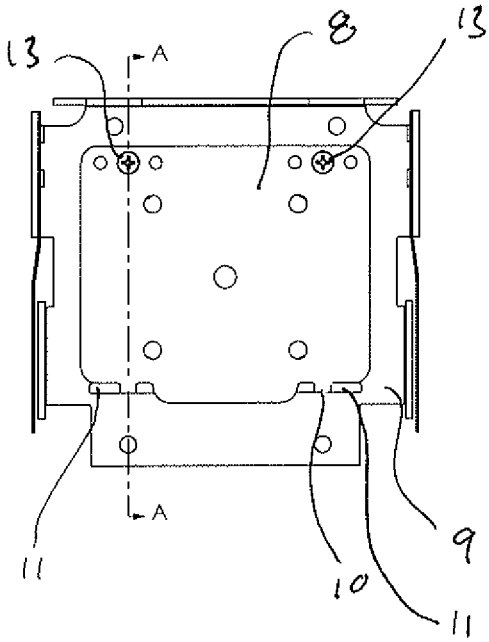
FIG. 5 is a side elevational view of the head box end panel shown in FIG. 4.
Figure 6:
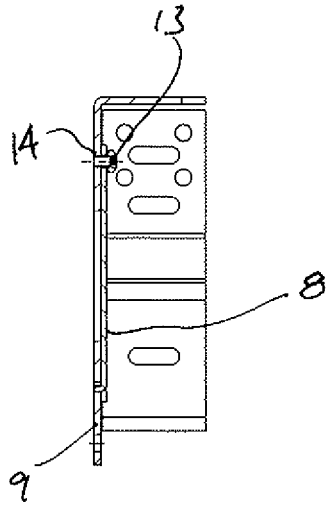
FIG. 6 is a sectional view taken along the line A-A of FIG. 5.
Figure 7:
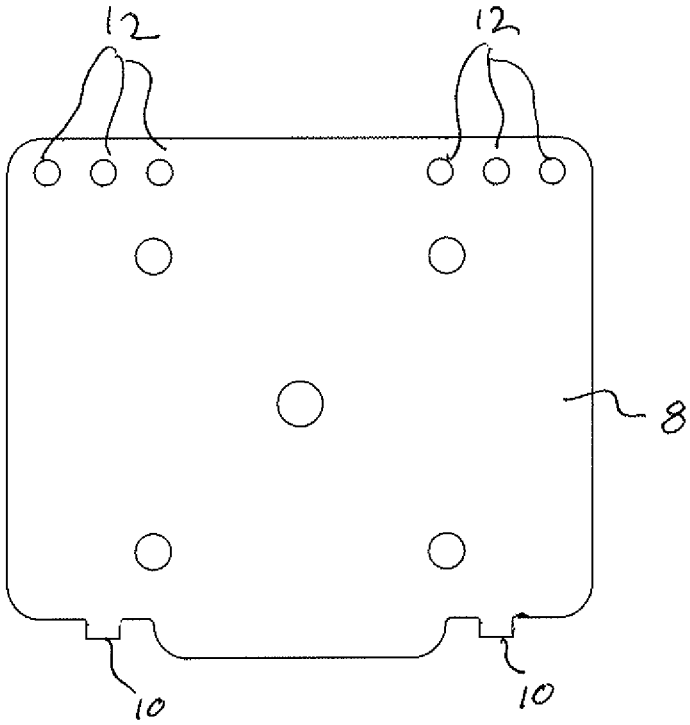
FIG. 7 is a front elevational view of a roller blind end bracket plate in accordance with an embodiment of the present invention.
Figure 8:
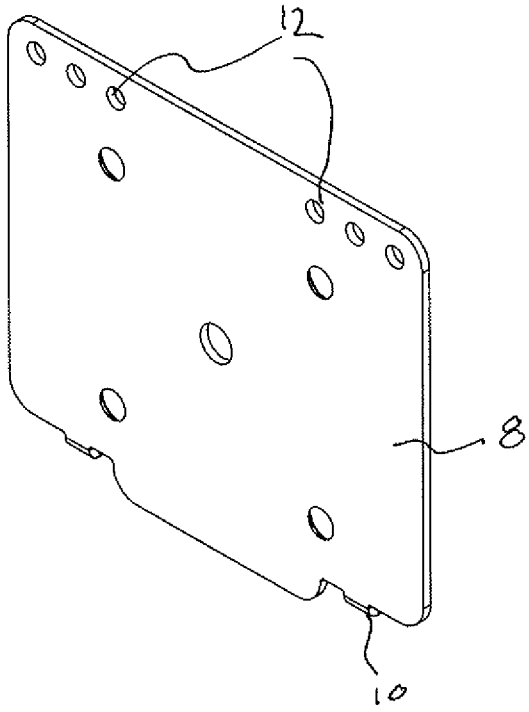
FIG. 8 is an upper right side perspective view of the roller blind end bracket plate shown in FIG. 7.
Figure 9:
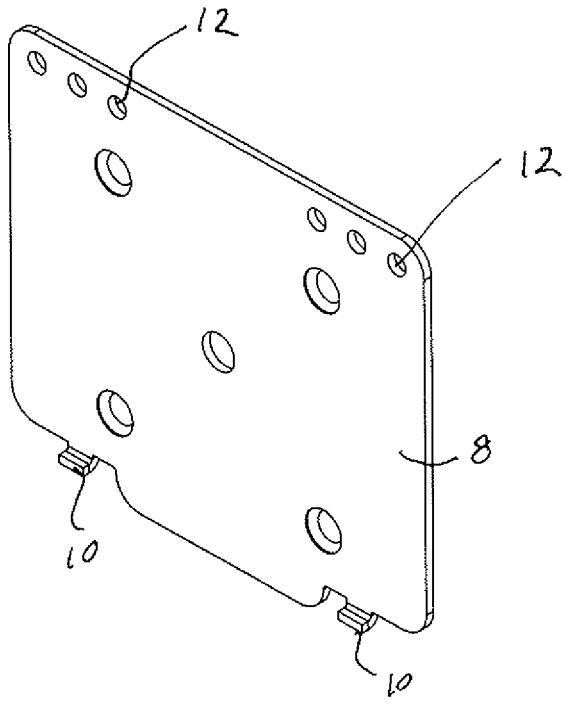
FIG. 9 is an upper left side perspective view of the roller blind end bracket plate shown in FIG. 7.
Figure 10:
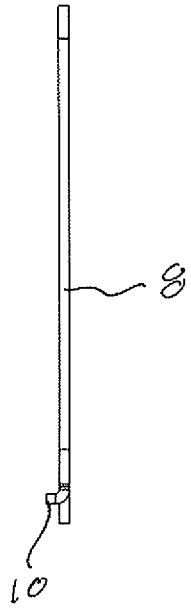
FIG. 10 is a side elevational view of the roller blind end bracket plate shown in FIG. 7.

In the attached drawings, and in particular FIGS. 1 through 3, there is shown a head box enclosure 1 as it would typically be mounted in a ceiling or bulkhead 2. Head box enclosure 1 is generally situated above and adjacent to a window frame 3 having a window glass 4. Within the head box is mounted a roller blind 5 comprised generally of a core or roller 6 and blind fabric 7. The ends of core 6 are connected to end brackets (not shown) that would typically include a clutch mechanism and means for mounting or securing the core in place within head box 1.

In accordance with the invention, there is provided an end bracket plate 8 for roller blind 5 that is releasably securable to both the end bracket of the roller blind and to the end panel 9 of head box enclosure 1. In the attached drawings a single end bracket plate 8 is shown, however, it will be understood that an end bracket plate will be utilized at both ends of roller blind 5. The particular construction of bracket plate 8 is shown in detail in FIGS. 7 through 10. Plate 8 includes one or more outwardly extending flanges 10 that are receivable within one or more openings 11 in end panel 9 of head box 1. When the flanges are received within openings 11, plate 8, and roller blind 5 secured thereto, is effectively hung within the head box. In one embodiment, openings 11 in end panel 9 are in the form of generally horizontally oriented slots. It will thus be appreciated that with flanges 10 received within the horizontal slots in the end panel of the head box, bracket plate 8 may be slid in a horizontal direction relative to the head box. Horizontally moving the bracket plate relative to the head box will permit a horizontal adjustment of the position of roller blind 5, and hence an adjustment of the set-off of blind fabric 7 from window glass 4.

In the embodiment of the invention shown in the attached drawings, two outwardly extending flanges 10 are received within two generally horizontal slots 11 in end panel 9. While any reasonable number of flanges could theoretically be used, it has been found that two flanges, preferably spaced apart on the lower portion of plate 8, are sufficient to hang the end bracket plate within head box 1, while also restricting or limiting the tendency of the plate to rotate upon activation of the roller blind. It should be noted that if desired, rather than utilizing two separate openings 11 in the end panel of the head box, a single horizontally oriented slot or a series of individual openings may be formed in the end plate in order to receive the flanges. It will also be appreciated that through location of flanges 10 on a lower portion of bracket plate 8, the weight of the roller blind, when releasably secured to the bracket plate, will apply a rotational torque to the plate which will have a tendency to drive flanges 10 into openings 11, thereby helping to maintain the flanges within the openings and securely holding the roller blind within the head box.

End bracket plate 8 may also include one or more openings 12 designed to receive one or more fasteners 13 that may be used to assist in releasably securing the plate to end panel 9 of head box 1. Preferably, corresponding openings or bores 14 are located in end panel 9 at locations corresponding generally to the position of openings 12 in plate 8. In most instances it is expected that fasteners 13 will be bolts or screws and that openings or bores 14 in the end panel will be threaded to receive the bolts or screws therein. However, it will also be appreciated that a wide variety of other types of fasteners could equally be utilized.

In one embodiment, plate 8 includes a series of horizontally spaced-apart openings 12 that permit the bracket plate to be moved horizontally toward the rear or toward the front of the head box until such time as one of the series of horizontally spaced-apart openings 12 aligns with one of the openings 14 in the end plate. Once the respective openings are aligned a fastener may be inserted to secure plate 8 in place. As shown, the horizontally spaced-apart openings 12 are preferably positioned in the upper portion of bracket plate 8. In a further embodiment, plate 8 includes six horizontally spaced-apart openings 12 that receive at least two fasteners 13. From a thorough understanding of the invention it will also be appreciated that various other types of fastening mechanisms or devices (which could include, but are not limited to, Velcro™, spring clips, magnetic catches, rotary clasps, etc.) may be utilized in place of openings 12, openings 14 and fasteners 13 to help secure plate 8 in place.

With reference once again to FIGS. 1, 2 and 3, in one of the preferred embodiments, end bracket plate 8 includes at least three horizontally spaced apart openings 12 that permit bracket plate 8 to be secured to end panel 9 in a first, a second and a third horizontal position. When plate 8 is in its first position it is situated such that the roller blind is located generally adjacent to the rear portion of head box 1 (see FIG. 3). In this configuration the set-off of the blind fabric 7 from window glass 4 will be minimized. Such a configuration will be most useful when the bulkhead within which the head box is mounted it itself set-off from the window or where the roller blind contains a relatively small diameter core or roller. In this instance it will also be noted that flanges 14 are received in toward the inner-most portions of openings 11 and that fastener (or fasteners) 13 are received within the front-most opening (or openings) 12 in bracket plate 8.

FIG. 1 depicts a configuration where bracket plate 8 is in its second horizontal position such that the bracket plate and roller blind 5 are located generally centrally within head box 1. In this configuration it will be noted that flanges 11 are generally centered within openings or slots 9 and that fastener (or fasteners) 13 are received in a middle opening (or openings) in bracket plate 8.

Finally, FIG. 2 represents a configuration where bracket plate 8 is in its third position such that the plate and roller blind 5 are generally adjacent to the front of head box 1. In this configuration flanges 10 are situated in a forward or front position within openings or slots 11 and fastener (or fasteners) 13 will be positioned in the rearmost opening (or openings) 12 of bracket plate 8. The configuration shown in FIG. 2 would typically be utilized where there is desire to off-set the position of blind fabric 7 from window glass 4 or where roller blind 5 includes a large diameter core or roller, making it desirable to retract the blind fabric somewhat away from window frame 3 so that there is no interference with the frame during operation of the blind. It should be noted that although FIGS. 1 through 3 depict an embodiment where plate 8 can be secured in one of three distinct horizontal positions, if desired the number of available positions can be altered by simply providing more or fewer openings 12.

It will thus be appreciated from a thorough understanding of the invention that end bracket plate 8 provides a means to not only easily and quickly releasably secure a roller blind within a head box, but that it also presents a means to easily horizontally adjust and fix the roller blind in place at one of a variety of different horizontal locations within the box. The nature and structure of plate 8 also permits different degrees of set-off between the blind fabric and the window glass. The interaction of flanges 10 and openings or slots 11 permit the roller blind to be held in a manner that allows for its horizontal adjustment while still retaining the roller blind within the head box. Once the desired horizontal adjustment has been made fasteners 13 can be inserted through end bracket plate 8 and into end panel 9 to more securely hold the roller blind in place and to prevent it from becoming dislodged from its adjusted horizontal location.

It is to be understood that what has been described are the preferred embodiments of the invention and that it may be possible to make variations to these embodiments while staying within the broad scope of the invention. Some of these variations have been discussed while others will be readily apparent to those skilled in the art.

We claim:

1. An end bracket plate for a roller blind, the end bracket plate releasably securable to an end bracket of the roller blind and releasably securable to the end panel of a head box enclosure, said end bracket plate including one or more outwardly extending flanges, said one or more flanges receivable within one or more openings in the end panel of the head box enclosure such that when received within the openings in the end panel said one or more flanges hang said end bracket plate and the roller blind secured thereto within the head box enclosure, said one or more openings in the end panel of the head box enclosure comprising one or more generally horizontal slots that permit a generally horizontal adjustment of the position of said end bracket plate within the head box enclosure.

2. The end bracket plate as claimed in claim 1 including one or more openings to receive one or more fasteners, said fasteners releasably securing said plate to the end panel of the head box enclosure.

3. The end bracket plate as claimed in claim 2 including a series of horizontally spaced apart openings therethrough, said openings in said plate permitting one or more fasteners to be inserted through said plate and into the end panel of the head box enclosure so that said plate may be positioned at discrete horizontal locations within the head box enclosure.

4. The end bracket plate as claimed in claim 3 including two outwardly extending flanges receivable within two generally horizontal slots in the end panel of the head box enclosure.

5. The end bracket plate as claimed in claim 1 including at least three horizontally spaced apart openings therethrough, said openings in said plate permitting said plate to be secured to the end panel of the head box enclosure in a first, a second and a third horizontal position, when in said first position said plate situated such that the roller blind is located generally adjacent to the rear of the head box enclosure, when in said second position said plate situated such that the roller blind is located generally centrally within the head box enclosure, when in said third position said plate situated such that the roller blind is located generally adjacent to the front of the head box enclosure.

6. The end bracket plate as claimed in claim 1 including holes extending therethrough to receive fasteners for securing said bracket plate to the end bracket of the roller blind.

7. The end bracket plate as claimed in claim 1 wherein the weight of the roller blind, when releasably secured to said bracket plate, applies a torque to said plate, said torque helping to maintain said flanges within the openings in the end panel of the head box enclosure.

8. The end bracket plate as claimed in claim 7 wherein said flanges are positioned on the lower portion of said plate.

9. The end bracket plate as claimed in claim 5 including at least 6 horizontally spaced apart openings therethrough that receive at least two fasteners to assist in releasably securing said plate to the end panel of a head box enclosure.

10. The end bracket plate as claimed in claim 9 wherein said horizontally spaced apart openings through said plate are positioned in the upper portion of the plate.

* * * * *